US006505676B1

(12) United States Patent
Stürmer et al.

(10) Patent No.: US 6,505,676 B1
(45) Date of Patent: Jan. 14, 2003

(54) METHOD AND DEVICE FOR CASTING A STRAND OF LIQUID METAL

(75) Inventors: Uwe Stürmer, Baiersdorf (DE); Bernhard Weisshaar, Herzogenaurach (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 09/762,348

(22) PCT Filed: Jul. 23, 1999

(86) PCT No.: PCT/DE99/02273

§ 371 (c)(1),
(2), (4) Date: Feb. 5, 2001

(87) PCT Pub. No.: WO00/07756

PCT Pub. Date: Feb. 17, 2000

(30) Foreign Application Priority Data

Aug. 5, 1998 (DE) ..... 198 35 421

(51) Int. Cl.[7] ..... B22D 11/18
(52) U.S. Cl. ..... 164/453; 164/449.1
(58) Field of Search ..... 164/453, 449.1

(56) References Cited

U.S. PATENT DOCUMENTS 5,311,924 A 5/1994 Kazuya et al.
5,915,456 A * 6/1999 Niemann et al. ..... 164/151.1

FOREIGN PATENT DOCUMENTS

| | | |
|---|---|---|
| DE | 19633738 | 2/1998 |
| JP | 04339552 | 11/1992 |
| JP | 07232252 | 9/1995 |
| JP | 08243703 | 9/1996 |

OTHER PUBLICATIONS

Niemann M. et al: "Modular Aufgerbaute Giessspiegelregelung Fuer Stranggiessanlagen" pp. 77–83.

* cited by examiner

*Primary Examiner*—Kuang Y. Lin
(74) *Attorney, Agent, or Firm*—Baker Botts LLP

(57) ABSTRACT

A method and device are provided for casting a strand of liquid metal which is cast into a mold, and which is drawn as a strand out of the mold. The casting level, e.g., a level of the liquid metal in the mold, is regulated to a predetermined casting-level desired value using a casting-level controller having at least one integrator. The output of the integrator of the casting-level controller is replaced by a predetermined value when the difference between the casting-level actual value and the casting-level desired value exceeds a tolerance threshold.

12 Claims, 4 Drawing Sheets

METHOD AND DEVICE FOR CASTING A STRAND OF LIQUID METAL

FIELD OF THE INVENTION

The present invention relates to a method and device for casting a strand of liquid metal which is cast into a mold and is drawn out of the mold.

BACKGROUND INFORMATION

In continuous casting, a strand is cast from liquid metal by means of a mold and is drawn out of the mold. An essential factor for a high quality of the strand cast in this way is keeping the casting level (i.e., the level of liquid metal in the mold) constant. It is known to regulate the casting level. In this case, it is difficult to design a controller, since the parameters of the control system, that is to say of the casting apparatus and mold, are subject to sometimes pronounced fluctuations or disturbance variables act on the casting level.

As illustrated in FIG. 1, during continuous casting, liquid metal flows via a dip pipe with an outlet orifice into the mold. The inflow of liquid metal via the dip pipe into the mold is influenced by a plug. Particularly where ferritic steels are concerned, deposits may occur on the plug or in the region of the dip pipe, with the result that the inflow is reduced. These slow disturbing influences can be compensated in a simple way by the casting level being regulated. In this case, as a result of regulation, the orifice is increased according to the extent of the deposits. If these deposits break away, however, there is an abrupt increase in the inflow of liquid metal into the mold. It has been shown that such abrupt changes in the inflow of liquid metal into the mold lead to sharp rises in the casting level and therefore to losses of quality in the cast strand.

Accordingly, the object of the present invention is to specify a method and a device for casting a strand of liquid metal by means of a mold, by means of which method and device the effects on the casting level by breakaways of deposits, for example on the plug or in the region of the dip pipe, are reduced.

SUMMARY OF THE INVENTION

The object is achieved, according to the present invention, with a method and device described herein. For example, for casting a strand, liquid metal is cast into a mold and is drawn as a strand out of the mold, the casting level, that is to say the level of the liquid metal in the mold, being regulated to a predetermined casting-level desired value using a casting-level controller. The difference between the casting-level actual value and casting-level desired value is advantageously monitored, and the casting-level controller outputs a predetermined additional value when the difference between the casting-level actual value and casting-level desired value exceeds a tolerance threshold.

The object of the present invention is additionally achieved with an exemplary embodiment of the present invention in that, for casting a strand, liquid metal is cast into a mold and is drawn as a strand out of the mold. The casting level (i.e., the level of the liquid metal in the mold) is regulated to a predetermined casting-level desired value using a casting-level controller, and the difference between the casting-level actual value and casting-level desired value advantageously is monitored. A predetermined additional value is added to the output of the casting-level controller when the difference between the casting-level actual value and casting-level desired value exceeds a tolerance threshold. The sum of the additional value and of the previous output value of the casting-level controller then forms the new output value of the casting-level controller.

According to another embodiment of the present invention, for casting a strand, liquid metal is cast into a mold and is drawn as a strand out of the mold, the casting level, that is to say the level of the liquid metal in the mold, being regulated to a predetermined casting-level desired value by means of a casting-level controller having at least one integrator, and the difference between the casting-level actual value and casting-level desired value advantageously being monitored. The output of the integrator of the casting-level controller is replaced by a predetermined additional value when the difference between the casting-level actual value and casting-level desired value exceeds a tolerance threshold. Supplementing in this sense means that the output of the integrator is replaced by the additional value or that, in a particularly advantageous way, the additional value is added to the integrator output, the sum of the additional value and of the previous output value of the integrator forming the new output value of the integrator.

In a particularly advantageous embodiment of the present invention, the tolerance threshold is adapted to the casting process, in particular as a function of the standard deviation of the difference between the casting-level actual value and casting-level desired value or of a variable equivalent to the standard deviation. It is thereby possible to prevent casting-level fluctuations due to the possible faulty detection of a breakaway, even though no breakaway has taken place.

According to yet another advantageous embodiment of the present invention, the tolerance threshold is limited to a value of between 0.02 and 0.1, of between 0.04 and 0.1 and/or of between 0.06 and 0.1. The stability of a method according to the present invention is increased in this way.

BRIEF DESCRIPTION OF THE DRAWINGS

In order to elucidate an exemplary embodiment of the present invention in further detail, reference is made to the drawings, in which.

DETAILED DESCRIPTION

Figure 1:
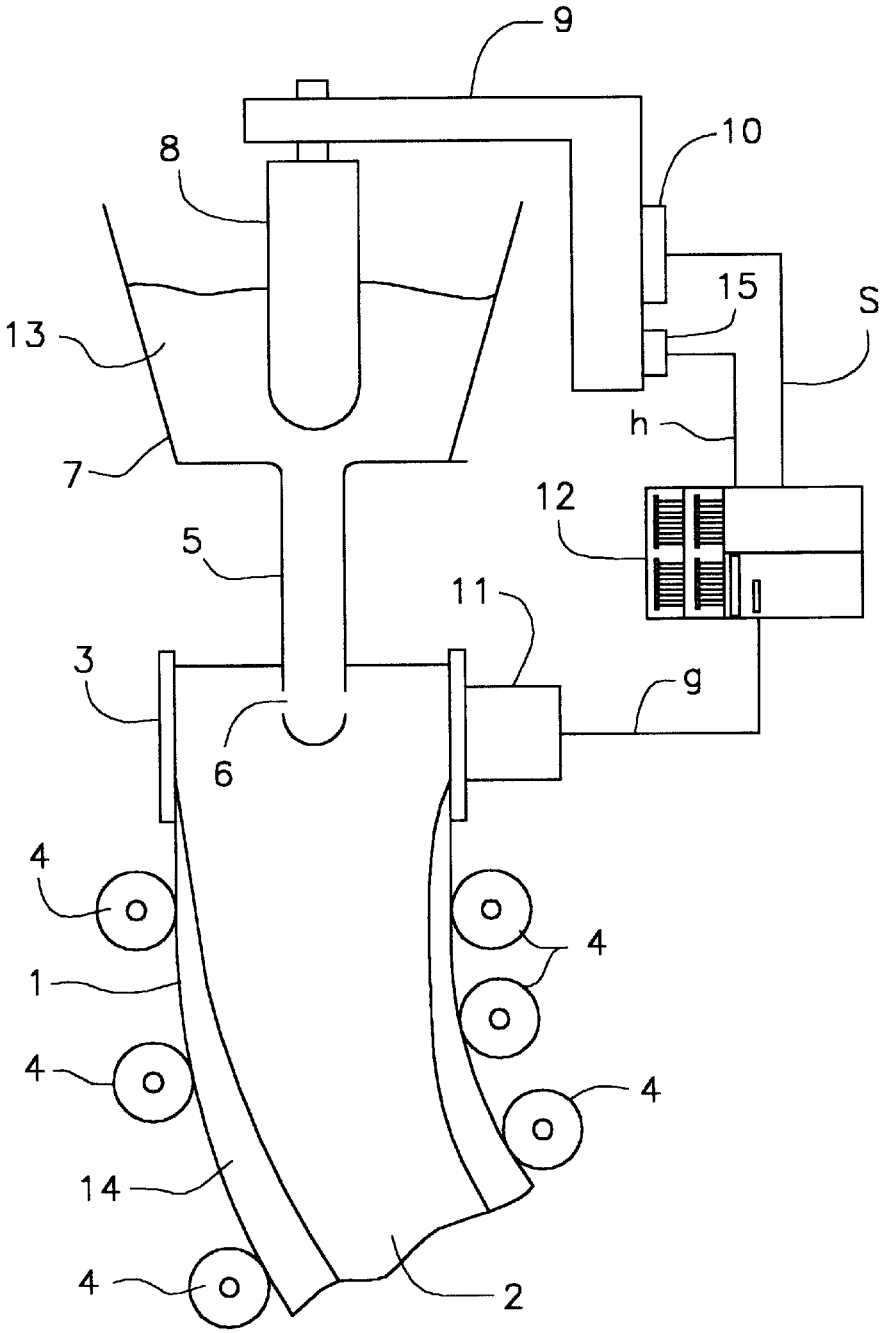
FIG. 1 shows an arrangement for continuous casting.

In an exemplary arrangement shown in FIG. 1, liquid metal 13, in this case steel, is cast into a distributor trough 7. The liquid metal flows out of the distributor trough 7 via a dip pipe 5 with an outlet orifice 6 into the mold 3. A strand 1 is formed from the liquid metal in the mold 3, and is drawn out of the mold 3 via rollers 4. The inflow of liquid metal 13 via the dip pipe 5 into the mold 3 is influenced using a plug 8 which is moved via a mechanism 9 having a carrying arm and a lifting rod. The lifting rod is driven, in turn, by a hydraulic cylinder 10 which is controlled or regulated as a function of a hydraulic-cylinder correcting variable S via an automation unit 12. The position of the lifting rod and consequently the plug position h is measured by means of a position meter 15 and transmitted to the automation unit 12.

Moreover, the arrangement has a casting-level meter 11 which measures the casting level g, that is to say the level of liquid metal in the mold 3. The casting-level meter 11, as well as the position meter 15 and the hydraulic cylinder 10, are connected for data transmission purposes to the automation unit 12. The automation unit 12 regulates the casting level g. The strand 1 drawn out of the mold 3 has a liquid phase, that is to say a liquid core 2, and a solidified skin 14.

Figure 2:
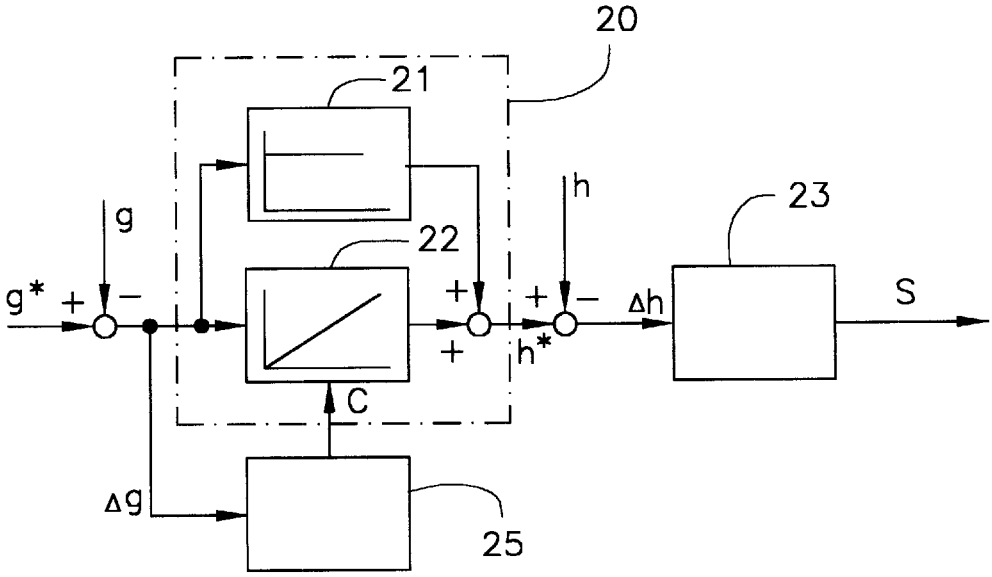
FIG. 2 shows an exemplary embodiment of the present invention.

FIG. 2 shows an exemplary embodiment of a device according to the present invention. A casting-level controller 20 and a plug-position controller 23 are provided for regulating the casting level g. The casting-level controller 20 has a P element 21 and an integrator 22. The casting-level controller 20 determines a plug-position desired value h* as a function of the difference between a casting-level desired value g* and the casting level g. The plug-position controller 23 determines a correcting variable s for the lifting cylinder 10 as a function of a plug-position control difference Δh. The plug-position control difference Δh is the difference between the plug-position desired value h* and the plug position h.

In order to compensate breakaways of deposits on the plug 8 or of deposits in the region of the dip pipe 5, a breakaway pilot control arrangement 24 is provided. The breakaway pilot control arrangement 24 determines an additional value c as a function of the control deviation Δg. In a particularly advantageous embodiment of the present invention, there is provision, in a sensing step, for supplementing the output of the integrator 22 by the additional value c and resetting it when the negative control deviation −Δg exceeds a specific tolerance value. The control deviation Δg is the difference between the casting-level desired value g* and casting-level actual value g.

Figure 3:
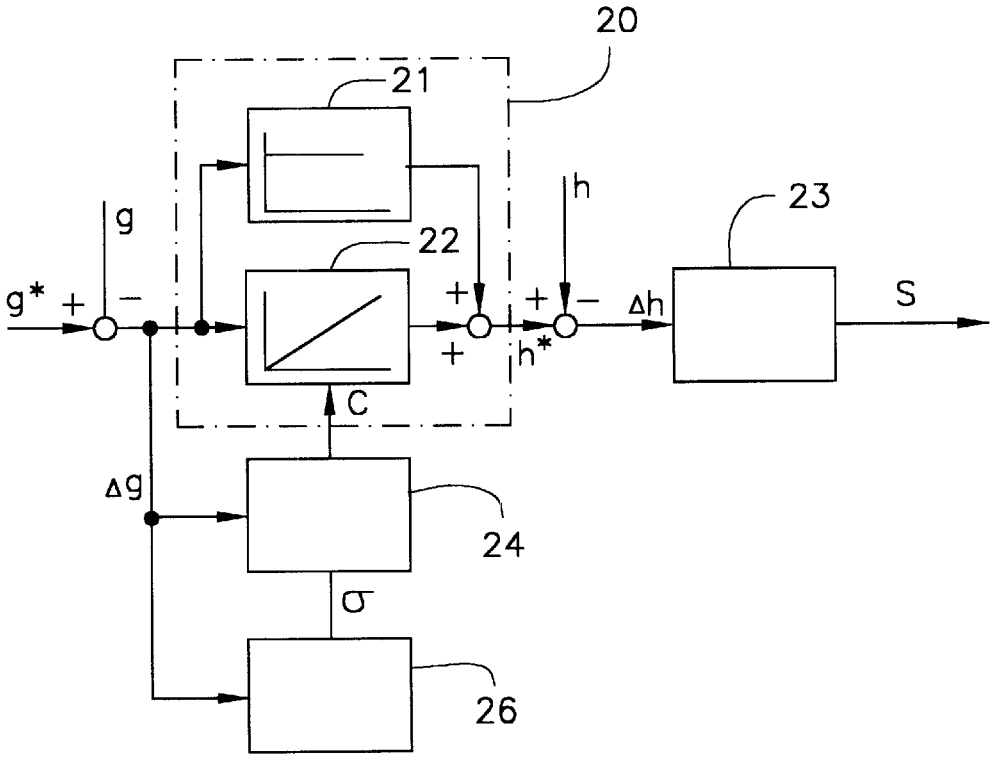
FIG. 3 shows a another advantageous exemplary embodiment of the present invention.

FIG. 3 shows another advantageous exemplary embodiment of the present invention. In this embodiment, instead of the breakaway pilot control 24 as illustrated in FIG. 2, a breakaway pilot control 25 and a statistic block 26 are provided. The breakaway pilot control 24 of FIG. 2 and the breakaway pilot control 25 of FIG. 3 differ from one another essentially in that the tolerance thresholds according to the breakaway pilot control 25 are determined as a function of the standard deviation a of the control deviation Δg over a specific time window. Instead of the standard deviation a, however, an equivalent variable may also be used. The standard deviation a is determined by means of the statistic block 26 which, in the present exemplary embodiment, is a standard-deviation former over a specific time window. It may, however, be replaced by more complex statistical function modules and also fuzzy logic or neuronal networks.

Figure 4:
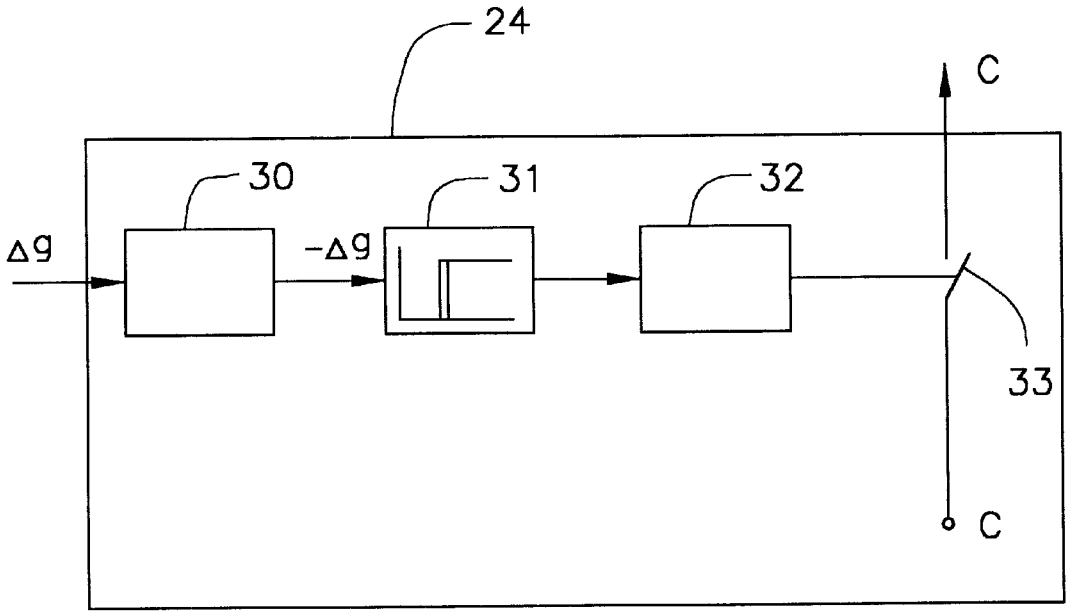
FIG. 4 shows an exemplary embodiment of a breakaway pilot control as illustrated in FIG. 2.

FIG. 4 shows an exemplary embodiment of a breakaway pilot control 24 illustrated in FIG. 2. This exemplary breakaway pilot 24 has an negator 30 for negating the control deviation −Δg. Furthermore, the breakaway pilot control 24 has a tolerance-value-tester 31, a holding element 32 and a switch 33. The tolerance-value tester 31 checks whether the negative control deviation −Δg exceeds a specific tolerance value. If the tolerance-value tester 31 detects that the negative control deviation −Δg exceeds a specific tolerance value, the holding element 32 closes the switch 33 for a sensing step. In this sensing step, the breakaway pilot control 24 outputs an additional value c. When the breakaway pilot control 24 outputs an additional value c, the output value of the integrator 22 shown in FIG. 2 is supplemented by the additional value c and is reset. In an advantageous embodiment of the breakaway pilot control 24 which is not illustrated, the additional value c is composed of a plurality of staggered values $c_1$,$c_2$, $c_3$, as shown in the exemplary embodiment of FIG. 5. The effects of breakaways on the casting level are reduced particularly sharply by tolerance thresholds being staggered in this way.

Figure 5:
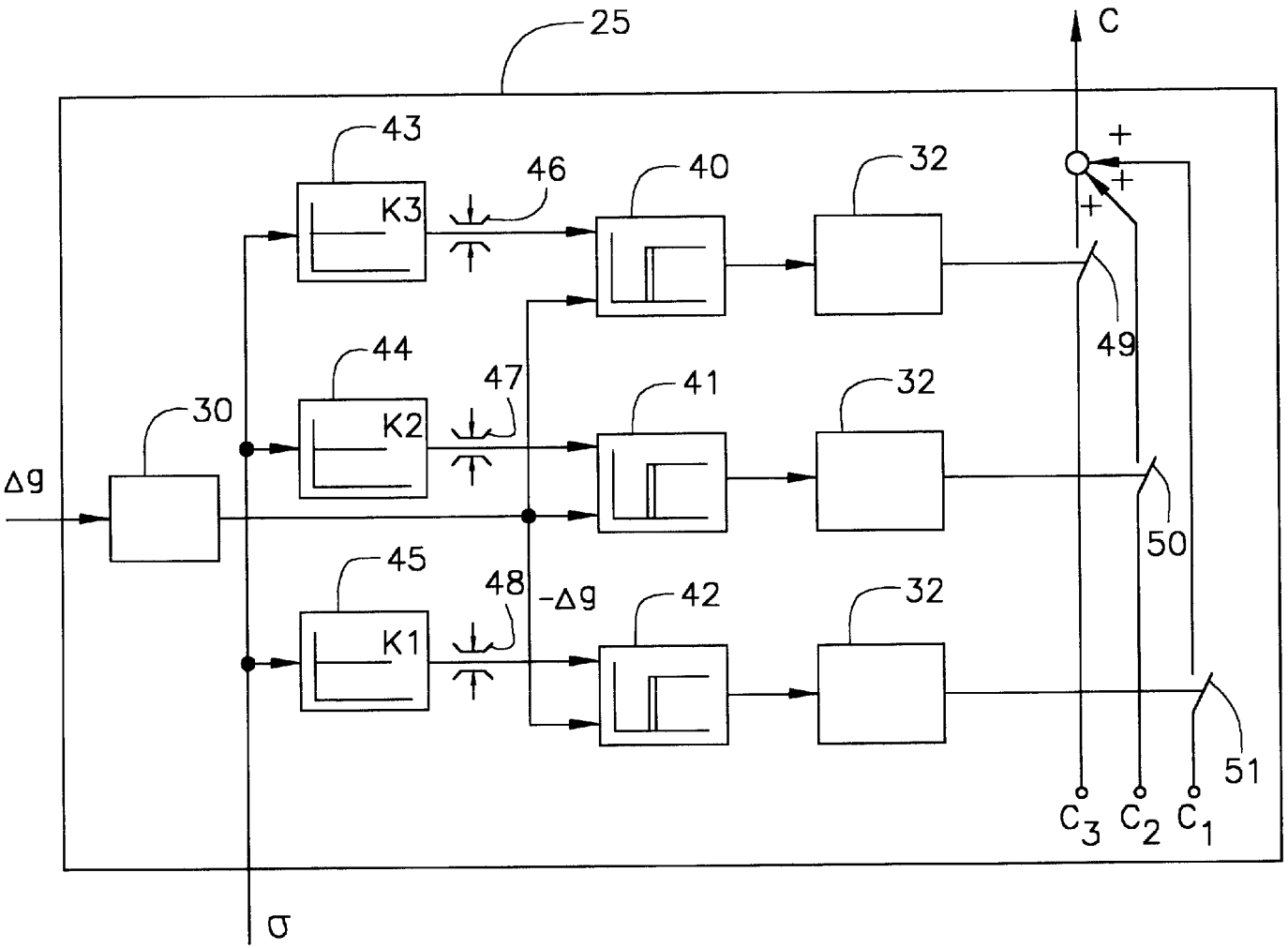
FIG. 5 shows a another advantageous exemplary embodiment of a breakaway pilot control as illustrated in FIG. 3.

FIG. 5 shows a particularly advantageous exemplary embodiment of a breakaway pilot control illustrated in FIG. 3. This embodiment of the breakaway pilot control 25 has a negator 30, holding elements 32, tolerance-value testers 40, 41, 42, P elements 43, 44, 45 with the amplifications $K_3$, $K_2$, $K_1$, limiters 46, 47, 48 and switches 49, 50 and 51. According to this refinement of the breakaway pilot control 25, tolerance values advantageously adapted to the casting process are provided for the tolerance-value testers 40, 41, 42. For this purpose, the standard deviation σ is multiplied by means of the P elements 43, 44, 45 by an amplification $K_3$, $K_2$, $K_1$, and is subsequently limited by the limiters 46, 47, 48. The output value of the limiters 46, 47, 48 is the tolerance value which is used in the tolerance-value tester 40, 41, 42. In the tolerance-value testers 40, 41, 42, a check is made as to whether the negative control deviation −Δg exceeds this tolerance value. When one of the tolerance-value testers 40, 41, 42 determines that its tolerance value is exceeded by the negative control deviation −Δg, the corresponding holding-element 32 closes the corresponding switch 49, 50, 51. An additional value c is output according to the combination of closed switches 49, 50, 51. When additional value c is applied, the output of the integrator 22 shown in FIG. 3 is supplemented, in this sensing step, by the additional value c and is reset.

What is claimed is:

1. A method of casting a strand of liquid metal poured into a mold and drawn therefrom, comprising controlling the level of the liquid metal poured into the mold, by means of a control having a preassigned target pour level, whereby the control supplies an original control value formed as a function of a preassigned supplement, the supplement being provided when a difference between an actual pour level of liquid metal in the mold and a target pour level exceeds a tolerance value, further comprising providing a plurality of staggered tolerance values by which the difference between the actual pour level and the target pour level is compared, assigning to each of said tolerance values a specific supplement and, upon detection of a transgression of the tolerance value, supplying the specific supplement for said value to the pour level of liquid metal in the mold.

2. The method according to claim 1, wherein a supplement is added to the original control value, or replaces said original control value.

3. The method according to claim 1, further comprising providing the original control value by an integrator.

4. The method according to claim 1, further comprising determining the tolerance value as a function of a standard deviation of the difference between the actual pour level and the target pour level.

5. The method according to claim 1, wherein the tolerance value is limited to a value between 0.02 and 0.1.

6. The method according to claim 5, wherein the tolerance value is limited to a value between 0.04 and 0.1.

7. The method according to claim 6, wherein the tolerance value is limited to a value between 0.06 and 0.1.

8. An apparatus for casting a strand of liquid metal, poured into a mold and drawn therefrom, comprising a pour level control to control the level of liquid metal in the mold, said control having an original control value formed as a function of a supplement supplied when a difference between an actual pour level and a target pour level exceeds a tolerance value, further comprising an interrupt pre-control to supply the supplement which is capable of comparing the difference between the actual pour level and the target pour level, and having a plurality of staggered tolerance values for activating the supply of a desired supplement associated with a tolerance value when the difference exceeds a certain tolerance value.

9. The apparatus according to claim 8, wherein the interrupt pre-control adds the supplement to an original control value or replaces the original control value with the supplement.

10. The apparatus according to claim 8, wherein the pour level control further comprises an integrator which provides the original control value.

11. The apparatus according to any of claim 8, wherein the interrupt pre-control determines a tolerance value as a function of a standard deviation of the difference between actual pour level and target pour level.

12. Apparatus according to claim 8, further comprising a statistical block in order to determine the standard deviation.

* * * * *